US010723155B2

(12) United States Patent
Fujino

(10) Patent No.: US 10,723,155 B2
(45) Date of Patent: Jul. 28, 2020

(54) INKJET RECORDING APPARATUS AND METHOD OF CONTROLLING INKJET RECORDING APPARATUS

(71) Applicant: Konica Minolta, Inc., Tokyo (JP)

(72) Inventor: Akira Fujino, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/540,437

(22) PCT Filed: Jan. 7, 2016

(86) PCT No.: PCT/JP2016/050282
§ 371 (c)(1),
(2) Date: Jun. 28, 2017

(87) PCT Pub. No.: WO2016/114204
PCT Pub. Date: Jul. 21, 2016

(65) Prior Publication Data

US 2018/0264847 A1 Sep. 20, 2018

(30) Foreign Application Priority Data

Jan. 14, 2015 (JP) ..... 2015-004880

(51) Int. Cl.
*B41J 25/308* (2006.01)
*B41J 2/045* (2006.01)
(Continued)

(52) U.S. Cl.
CPC ..... *B41J 25/308* (2013.01); *B41J 2/04528* (2013.01); *B41J 2/04531* (2013.01);
(Continued)

(58) Field of Classification Search
CPC ..... B41J 2/01; B41J 11/002; B41J 11/04
See application file for complete search history.

(56) References Cited

U.S. PATENT DOCUMENTS

2011/0316935 A1* 12/2011 Sato ..... B41J 2/14274 347/63
2013/0135370 A1* 5/2013 Oba ..... B41J 2/135 347/9
(Continued)

FOREIGN PATENT DOCUMENTS

CN 103373084 A 10/2013
JP 2010076207 A 4/2010
(Continued)

OTHER PUBLICATIONS

Written Opinion of the International Searching Authority dated Mar. 15, 2016 from corresponding International Application No. PCT/JP2016/050282 and English translation.
(Continued)

*Primary Examiner* — Alessandro V Amari
*Assistant Examiner* — Kendrick X Liu
(74) *Attorney, Agent, or Firm* — Lucas & Mercanti, LLP

(57) ABSTRACT

An inkjet recording apparatus includes a conveying unit, a recording unit, a heat source, a heat source moving unit and a heat source moving control unit. The conveying unit performs a conveying operation to move a conveying member thereby conveying a recording medium placed on a conveying surface of the conveying member. The recording unit records an image by ejecting ink to the recording medium conveyed by the conveying unit. The heat source moving unit moves the heat source. The heat source moving control unit moves the heat source by the heat source moving unit such that a distance between the heat source and the conveying surface increases when the conveying operation which is performed by the conveying unit stops in a manner in which the conveying operation can be resumed in a state where the heat source is positioned in proximity of the conveying surface.

9 Claims, 6 Drawing Sheets

(51) Int. Cl.

| | |
|---|---|
| ***B41J 25/304*** | (2006.01) |
| ***B41J 2/175*** | (2006.01) |
| ***B41J 11/00*** | (2006.01) |
| *B41J 25/00* | (2006.01) |
| *B41J 2/005* | (2006.01) |

(52) U.S. Cl.
CPC ..... *B41J 2/04563* (2013.01); *B41J 2/17593* (2013.01); *B41J 11/002* (2013.01); *B41J 25/304* (2013.01); *B41J 2/045* (2013.01); *B41J 2002/0055* (2013.01); *B41J 2025/008* (2013.01); *B41J 2202/21* (2013.01)

(56) References Cited

U.S. PATENT DOCUMENTS

2013/0257954 A1* 10/2013 Kyoso ..... B41J 2/07 347/14
2013/0265359 A1* 10/2013 Sugaya ..... B41J 11/002 347/16
2013/0278668 A1* 10/2013 Miyamoto ..... B41J 11/002 347/17
2013/0307893 A1* 11/2013 Suda ..... B41J 3/60 347/16

FOREIGN PATENT DOCUMENTS

JP 2013173326 A 9/2013
JP 2014004701 A 1/2014
JP 2013248887 A 9/2019

OTHER PUBLICATIONS

Office Action dated May 22, 2018 from corresponding Chinese Patent Application No. CN 201680005439.0 and English translation.
International Search Report dated Mar. 15, 2016 for PCT/JP2016/050282 and English translation.
Extended European Search Report dated Jul. 26, 2018 from corresponding European Application No. EP 16737275.4.
JPO, Notification of Reason(s) for Refusal, issued in connection to the Japanese Patent Application No. 2016-569327, dated May 28, 2019 with a full English Translation (8 pages).
JPO, Final Notification of Reason(s) for Refusal, issued in connection to the Japanese Patent Application No. 2016-569327, dated Aug. 21, 2019, with an English Translation (7 pages).
Office Action dated Mar. 28, 2019 from corresponding Chinese Patent Application No. CN 201680005439.0 and English translation.
European Office Action for corresponding Patent Application No. 16737275.4 dated Nov. 27, 2019 (6 pages).

* cited by examiner

INKJET RECORDING APPARATUS AND METHOD OF CONTROLLING INKJET RECORDING APPARATUS

CROSS REFERENCE TO RELATED APPLICATION

This Application is a 371 of PCT/JP2016/050282 filed on Jan. 7, 2016, which, in turn, claimed the priority of Japanese Patent Application No. 2015-004880 filed on Jan. 14, 2015, both applications are incorporated herein by reference.

TECHNICAL FIELD

The present invention relates to an inkjet recording apparatus and a method of controlling an inkjet recording apparatus.

BACKGROUND ART

Conventionally, an inkjet recording apparatus is known which records an image on a recording medium by ejecting ink from a plurality of nozzles provided on a recording head to the recording medium which is held and conveyed by a conveying surface of a conveying unit and by solidifying the ink. In such an inkjet recording apparatus, a heat source which increases the temperature of the conveying surface of the conveying unit can be arranged in the proximity of the conveying surface. For example, in the inkjet recording apparatus described in Patent Document 1, an ink heating unit which heats ink stored in a recording head is provided inside the recording head, and this ink heating unit and the recording head heated by the ink heating unit correspond to the heat source in the proximity of the conveying surface.

In such an inkjet recording apparatus, a conveying operation is usually performed by the conveying unit and the conveying surface and the heat source are relatively moved from each other. Therefore, heat from the heat source is transmitted substantially homogeneously to the conveying surface of the conveying unit. Thereby, the temperature of the recording medium held on the conveying surface becomes uniform, and ink ejected onto the recording medium is solidified in a uniform manner, and thus, an image of good image quality is recorded.

PRIOR ART DOCUMENTS

Patent Documents

Patent Document 1: JP 2010-76207 A

SUMMARY OF THE INVENTION

Problem to be Solved by the Invention

However, in the traditional inkjet recording apparatus, there is a problem that, when the conveying operation by the conveying unit is stopped, the relative positional relationship between the conveying surface and the heat source becomes constant, and the conveying surface is locally heated by heat from the heat source which results in unevenness in the temperature on the conveying surface of the conveying unit.

An object of the present invention is to provide an inkjet recording apparatus and a method of controlling an inkjet recording apparatus which can suppress the occurrence of the unevenness of temperature on the conveying surface of the conveying unit when the conveying operation by the conveying unit is stopped.

Means for Solving the Problem

To achieve the above object, the invention of an inkjet recording apparatus according to item 1 includes:

a conveying unit which performs a conveying operation to move a conveying member thereby conveying a recording medium placed on a conveying surface of the conveying member;

a recording unit which records an image by ejecting ink to the recording medium conveyed by the conveying unit;

a heat source;

a heat source moving unit which moves the heat source; and a heat source moving control unit which moves the heat source by the heat source moving unit such that a distance between the heat source and the conveying surface increases when the conveying operation which is performed by the conveying unit stops in a manner in which the conveying operation can be resumed in a state where the heat source is positioned in proximity of the conveying surface.

The invention according to item 2 is the inkjet recording apparatus according to item 1, wherein the recording unit includes a configuration which serves as the heat source, and the heat source moving unit moves the heat source by moving the recording unit.

The invention according to item 3 is the inkjet recording apparatus according to item 2, further including:

an ink heating unit which heats ink which is stored in the recording unit and which is to be ejected; and a heating control unit which heats the ink by the ink heating unit to a temperature higher than a temperature of the conveying surface of the conveying member, wherein the recording unit transmits heat of the ink heating unit to the configuration which serves as the heat source.

The invention according to item 4 is the inkjet recording apparatus according to item 3, wherein the heating control unit heats the ink by the ink heating unit to a temperature higher than a temperature of the conveying surface of the conveying member by 10° C. or more.

The invention according to item 5 is the inkjet recording apparatus according to item 3 or 4, wherein ink which is stored in the recording unit has a characteristic that the ink is gel-like at normal temperature and becomes sol-like when the ink is heated, the heating control unit heats the ink by the ink heating unit to a temperature at which the ink becomes sol-like, and the recording unit ejects the sol-like ink which is heated by the ink heating unit to the recording medium.

The invention according to item 6 is the inkjet recording apparatus according to any one of items 1 to 5, wherein the recording unit ejects ink from a plurality of recording elements arranged along a widthwise direction perpendicular to a conveying direction of the recording medium by the conveying unit over a recording width of the recording medium in the widthwise direction in a direction intersecting with the conveying direction.

The invention according to item 7 is the inkjet recording apparatus according to any one of items 1 to 6, wherein the conveying member includes the conveying surface having a cylindrical surface shape, and the conveying unit performs the conveying operation by rotating the conveying surface.

The invention according to item 8 is the inkjet recording apparatus according to any one of items 1 to 7, further including a conveying member heating unit which heats the conveying surface of the conveying member.

The invention according to item 9 is the inkjet recording apparatus according to any one of items 1 to 8, further including a conveying control unit which stops the conveying operation of the conveying unit when a predetermined abnormal condition occurs.

To achieve the above object, the invention according to item 10 is a method of control an inkjet recording apparatus including: a conveying unit which performs a conveying operation to move a conveying member thereby conveying a recording medium placed on a conveying surface of the conveying member; a recording unit which records an image by ejecting ink to the recording medium conveyed by the conveying unit; a heat source; and a heat source moving unit which moves the heat source, the method including:

a step of moving a heat source which moves the heat source by the heat source moving unit such that a distance between the heat source and the conveying surface increases when the conveying operation which is performed by the conveying unit stops in a manner in which the conveying operation can be resumed in a state where the heat source is positioned in proximity of the conveying surface.

Effects of the Invention

In accordance with the present invention, there is an effect that, when the conveying operation of the conveying unit is stopped, the occurrence of the unevenness of the temperature on the conveying surface of the conveying unit can be suppressed.

EMBODIMENTS FOR CARRYING OUT THE INVENTION

Hereinafter, embodiments of an inkjet recording apparatus and a method of controlling an inkjet recording apparatus will be explained with reference to the drawings.

Figure 1:
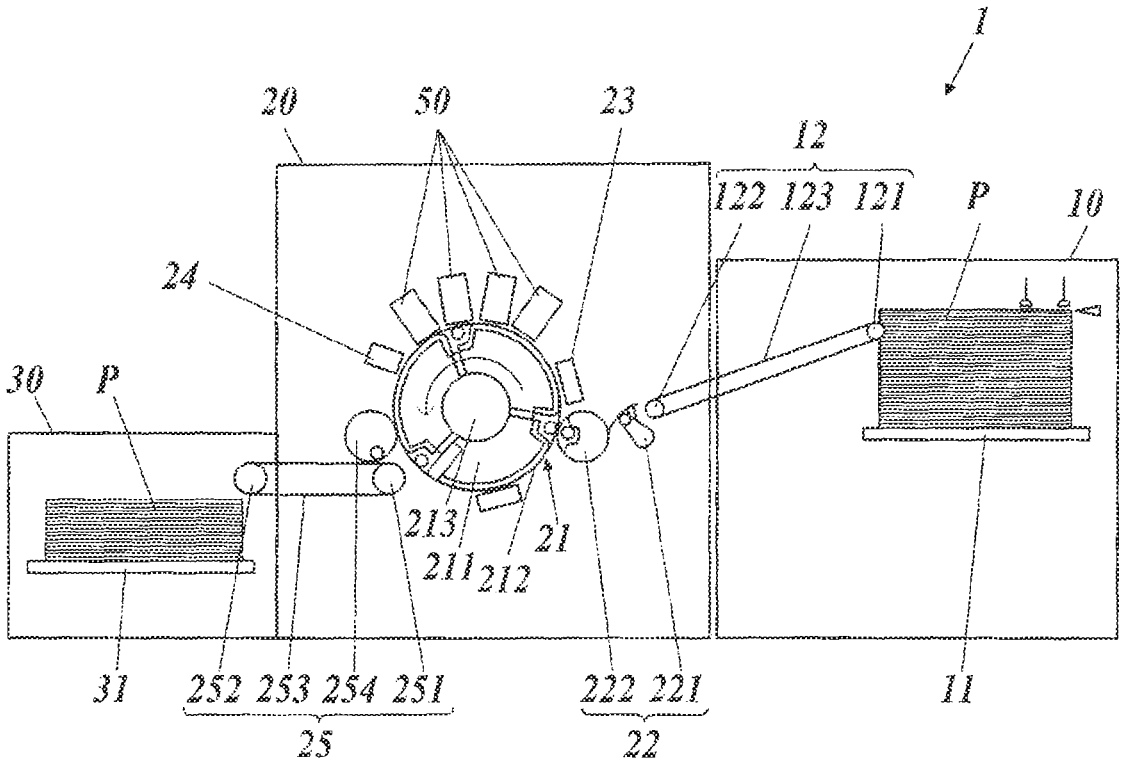
FIG. 1 is a view showing a schematic configuration of an inkjet recording apparatus which is an embodiment of the present invention.

FIG. 1 is a view showing a schematic configuration of an inkjet recording apparatus 1 which is an embodiment of the present invention.

Figure 4:
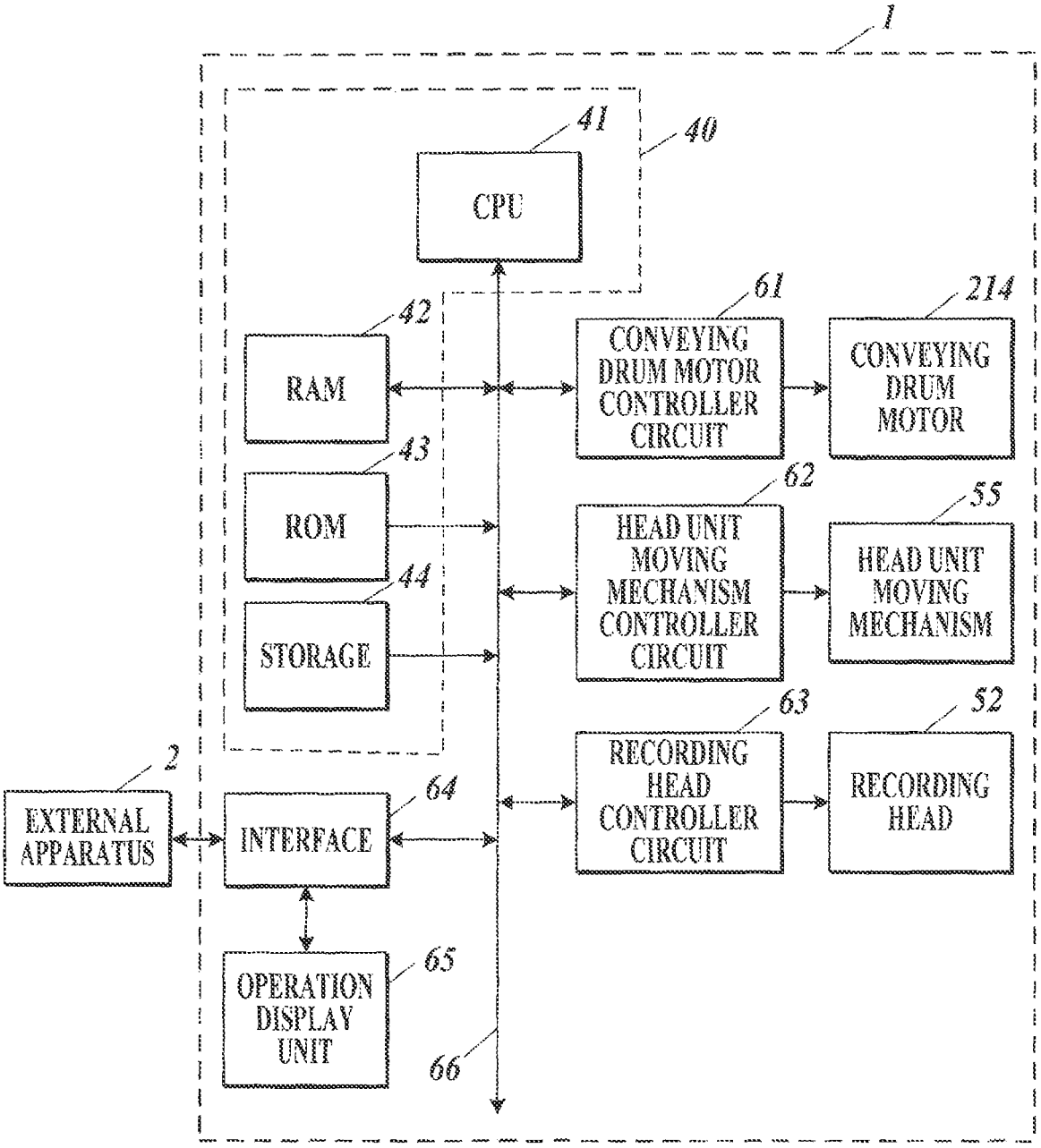
FIG. 4 is a block diagram showing a main functional configuration of the inkjet recording apparatus.

The inkjet recording apparatus 1 includes a sheet feeding unit 10, an image recording unit 20, a sheet ejecting unit 30 and a control unit 40 (FIG. 4). The inkjet recording apparatus 1, under the control of the controlling unit 40, conveys a recording medium P stored in the sheet feeding unit 10 to the image recording unit 20, records (forms) an image on the recording medium P in the image recording unit 20, and conveys the recording medium P on which an image is recorded to the sheet ejecting unit 30. As the recording medium P, a variety of medium can be used on which ink (color material) ejected on the surface thereof can be fixed such as paper, fabric and sheet-like resin.

The sheet feeding unit 10 includes a sheet tray which stores the recording medium P and a conveyer 12 which conveys the recording medium P from the sheet tray 11 to the image recording unit 20.

The conveyer 12 includes an endless belt 123 whose inner side is supported by two rollers 121 and 122. The conveyer 12 conveys the recording medium P by rotating rollers 121 and 122 in a state where the recording medium P is placed on the belt 123.

The image recording unit 20 includes a conveying unit (conveying unit) 21, a passing unit 22, a conveying drum heating unit (conveying member heating unit), a head unit 50, a fixing unit 24 and a delivery unit 25.

The conveying unit 21 includes abase 213 and a conveying drum (conveying unit) 211 which is attached to the base 213. The conveying drum 211 places and holds the recording medium P on a cylindrical conveying surface 212 which is the outer circumference of the conveying drum 211. The conveying unit 21 conveys the recording medium P in a conveying direction (hereinafter referred to as Y direction) along the conveying surface 212 by performing a rotating operation (hereinafter referred to also as conveying operation) which rotates the conveying drum 211 which holds the recording medium 212 around a rotating shaft of the conveying surface 212 which extends perpendicular to a direction (hereinafter referred to as X direction) extending the drawing of FIG. 1. The conveying drum 211 includes a stop and an air intake (not shown) to hold the recording medium P on the conveying surface 212. The recording medium P is held on the conveying surface 212 of the conveying drum 211 with the end thereof being held by the stop and with the recording medium P being suctioned to the conveying drum 212 by the air intake.

The conveying unit 21 includes a conveying drum motor 214 (FIG. 4) to rotate the conveying drum 211, and the conveying drum 211 rotates by an angle proportional to the rotating amount of the conveying drum motor 214.

The passing unit 22 passes the recording medium P which is conveyed by the conveyer 12 of the sheet feeding unit 10 to the conveying unit 21. The passing unit 22 is provided at a position between the conveyer 12 of the sheet feeding unit 10 and the conveying unit 21. The passing unit 22 holds and picks up an end of the recording medium P which is conveyed by the conveyer 12 with a swing arm unit 221 and passes to the conveying unit 21 via passing drum 222.

A conveying drum heating unit 23 heats the conveying surface 212 of the rotating conveying drum 211 of the conveying unit 21 and the recording medium P held on the conveying drum 211 to a predetermined set temperature. The conveying drum heating unit 23 includes an infrared heater or the like, for example. The infrared heater is heated in response to energization. The conveying drum heating unit 23 is provided at a position which is opposed to the conveying surface 212 of the conveying drum 211 and which is on the upstream side of the head unit 50 with respect to the conveying direction of the recording medium P. A temperature sensor (now shown) is provided in proximity of the conveying drum heating unit 23. The control unit 40 controls the heating of the conveying drum heating unit 23 such that the conveying surface 212 of the conveying drum 211 becomes the predetermined temperature based on the temperature near the conveying drum heating unit 23 which is detected by the temperature sensor. As a result, the recording medium P which is held and conveyed by the conveying drum 211 is also heated to the predetermined temperature.

The conveying drum heating unit 23 heats the conveying drum 211 to a temperature in the range of 40° C. or more and 60° C. or less, for example. This temperature range is a range by which an image of good image quality can be recorded on the recording medium P when the heating temperature of ink described below is in the range of 70° C. or more and 90° C. or less. In the present embodiment, the entire conveying drum 211 is heated to the temperature described above by the conveying drum heating unit 23. However, in place of this, a part of the conveying drum 211 including the conveying surface 212 may be heated to such a temperature.

The heating temperature of the conveying drum heating unit 23 may be changed as needed, for example, in case where the heating temperature of ink is changed in accordance with the type of the ink. Also, in case where the recording medium P on which an image of good image quality can be recorded even at a low temperature is used, the lower limit of the heating temperature of the conveying drum heating unit 23 may be a temperature less than 40° C.

The head unit 50 records an image by ejecting ink to the recording medium P held on the conveying unit 21. The head unit 50 is arranged so that the ink ejecting surface is spaced from the conveying surface 212 of the conveying unit 21 by a predetermined distance. The inkjet recording apparatus 1 of the present embodiment includes four head units 50Y, 50M, 50C and 50K (hereinafter referred merely to as a head units 50) which respectively correspond to four color ink of yellow (Y), magenta (M), cyan (C) and black (K). These four head units 50 are arranged at predetermined intervals in the order of colors Y, M, C and K from the upstream side along the conveying direction of the recording medium P.

Figure 2A:
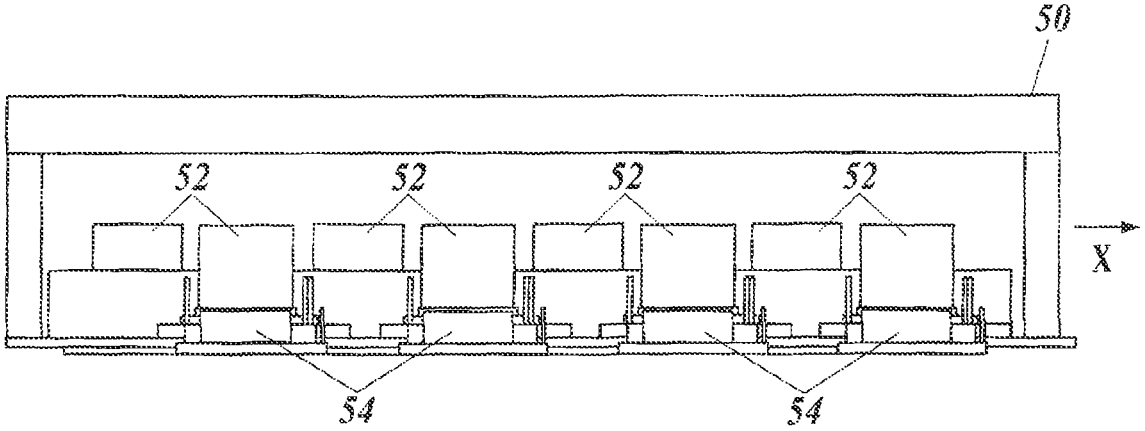
FIG. 2A is a schematic view showing an internal configuration of a head unit seen from side.
Figure 2B:
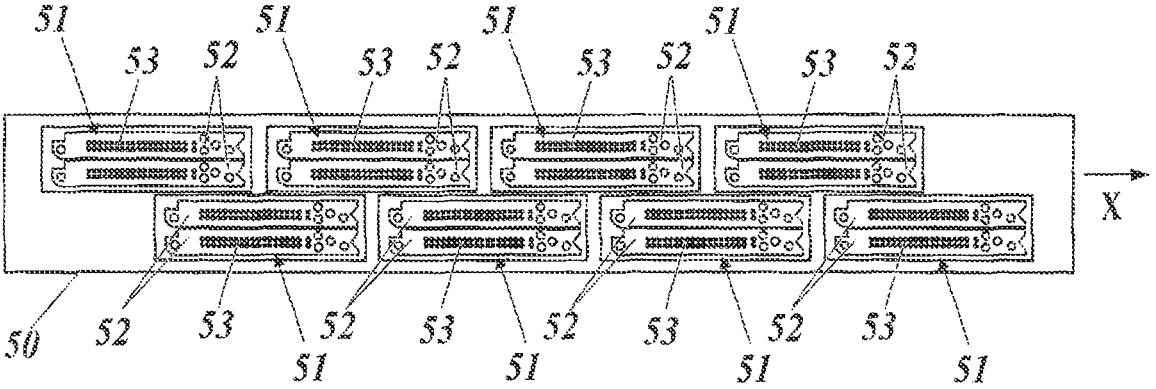
FIG. 2B is a schematic view showing an internal configuration of the head unit seen from the side of a conveying unit.

FIGS. 2A and 2B are views showing internal configuration of the head unit 50. FIG. 2A is a schematic view of internal configuration when the head unit 50 is seen from side. FIG. 2B is a schematic view of internal configuration when the head unit 50 is seen from the side of the conveying unit 21. When the head unit 50 is seen from side refers to when the head unit 50 is seen from a position of the conveying surface 212 which is opposed to the head unit 50 along a direction parallel to the conveying direction of the recording medium P.

As shown in FIGS. 2A and 2B, a single head unit 50 is provided with sixteen recording heads (recording unit, heat source) 52. The respective two recording heads 52 form a pair and the sixteen recording heads 52 constitutes eight recording head modules 51.

Each of the recording heads 52 includes a plurality of recording elements 53. Each recording element 53 includes a pressure chamber which stores ink, a piezoelectric element provided on the wall of the pressure chamber and a nozzle. When driving voltage is applied from a driving circuit of the recording head 52 to the piezoelectric element, the pressure in the pressure chamber is changed in response to the amount of driving voltage and ink is ejected from the nozzle which communicates with the pressure chamber. The nozzle of the recording element 53 has an opening on a surface of the side of the conveying unit 21 (ink ejecting surface). In FIG. 2B, a part of the openings of the nozzles included in the recording element 53 is depicted as dots.

The nozzles of the recording elements 53 which the recording head 52 includes are arranged along widthwise direction (X direction) perpendicular to the conveying direction (Y direction) of the recording medium P in a surface of the recording head 52 opposed to the conveying unit 21. In the present embodiment, the recording elements 53 are arranged with regular intervals along X direction. The nozzle array of the recording element 53 only needs to be arranged along a direction which intersects with the conveying direction. The nozzle array of the recording element 53 does not necessarily need to be arranged along a direction perpendicular to the conveying direction.

Each recording head 52 includes two rows of the recording elements 53 which are arranged along X direction. Therefore, each recording head module 51 includes four rows of the recording elements 53. In each recording head module 51, these four rows of the recording elements 53 each are arranged at different positions along X direction as a whole. The arrangement of the recording elements 53 means the arrangement of the nozzles of the recording elements 53 herein.

The eight recording head modules 51 which each head unit 50 includes are arranged in staggered manner such that the range of the arrangement thereof are partially overlapped with each other along X direction. The rows of the recording elements 53 of the first, third, fifth and seventh recording head modules are positioned along the same line, and the rows of the recording elements 53 of the second, fourth, sixth and eighth recording head modules are positioned along the same line.

The range of arrangement of the recording elements 53 which the head unit 50 includes along X direction covers the width along X direction of the area where an image is recorded on the recording medium P which is held and conveyed by the conveying unit 21 (recording width), and the position of the head unit 50 is fixed with respect to the conveying unit 21 when an image is recorded. That is, the inkjet recording apparatus 1 is an inkjet recording apparatus of single path.

As shown in FIG. 2A, each recording head 52 is provided with an ink heating unit (ink heating unit) 54. The ink heating unit 54 includes a heating wire or the like, for example, and the temperature of the ink heating unit 54 is increased by the heating wire being heated in response to energization. Heat transfer occurs between the recording head 52 and the ink stored inside of the recording head 52 in accordance with the temperature difference between the recording head 52 and the ink. Thus, by the recording head 52 being heated by the ink heating unit 54, the ink inside the recording head 52 is heated, and the temperature of the recording head 52 and that of the ink become the same in a steady state. Also, the recording head 52 includes a plurality of (for example, six) temperature sensors (not shown) in proximity of a part of the recording head 52 where ink is stored. The control unit 40 controls the heating of the ink heating unit 54 such that the temperature of ink stored in the recording head 52 becomes a predetermined value based on the average value of the temperatures detected by the temperature sensors of the recording head 52. The ink heating unit 54 heats the ink stored in the recording head 52 to the temperature of the range of 70° C. or more and 90° C. or less, for example. This heating temperature of ink may be changed in accordance with the type of ink.

FIG. 2A shows an example in which the ink heating unit 54 is attached to the outside of the exterior member of the recording head 52. However, the ink heating unit 54 may be attached to the inside of the exterior member of the recording head 52.

The recording head 52 of the present embodiment has a structure in which heat from the ink heating unit 54 is transferred to the entire recording head 52, and the entire recording head 52 corresponds to a heat source.

In the present embodiment, as the ink which is to be ejected from the nozzle of the recording element 53, ink which has a characteristic that the ink is gel-like at a normal temperature and becomes sol-like when the ink is heated. The head unit 50 includes an ink reservoir (not shown) in which ink to be supplied to the recording head 52 is stored, and a heating unit (not shown) which heats the ink in the ink reservoir to make it sol-like, and supplies sol-like ink to the recording head 52. The recording head 52 heats the sol-like ink supplied from the ink reservoir to a predetermined temperature by the ink heating unit 54 and ejects it. When the sol-like ink is ejected onto the recording medium P, the ink shortly becomes gel-like and is solidified by natural cooling after the ink droplet hits on the recording medium P.

The ink used in the present embodiment has the characteristic that the ink cures by irradiating energy ray such as ultraviolet ray in addition to the characteristic described above.

Each head unit 50 is used with a position thereof being fixed with respect to the conveying unit 21 when an image is recorded as described above. However, the relative position of each head unit 50 can be changed with respect to the conveying unit 21 when an image is not recorded.

Figure 3A:
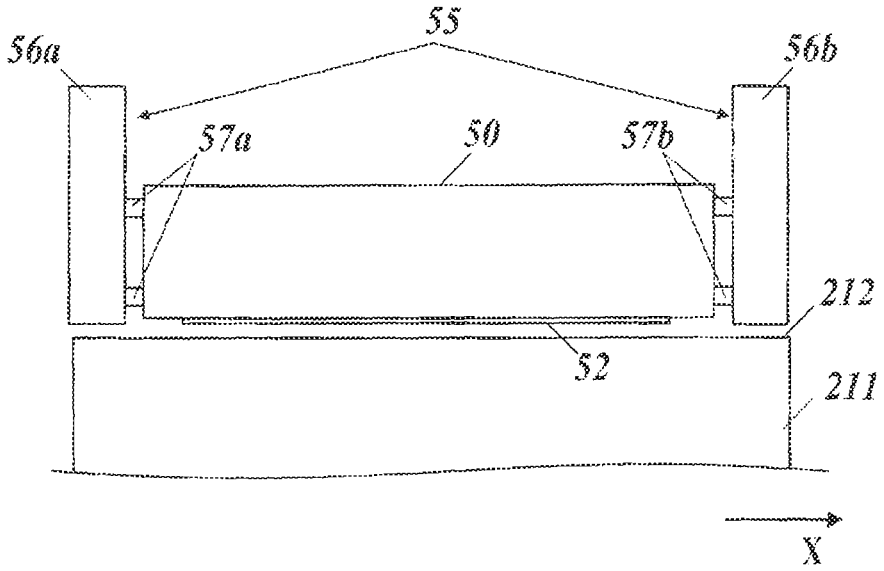
FIG. 3A is a view showing that the head unit is moved by a head unit moving mechanism and a recording head is at an operation position.
Figure 3B:
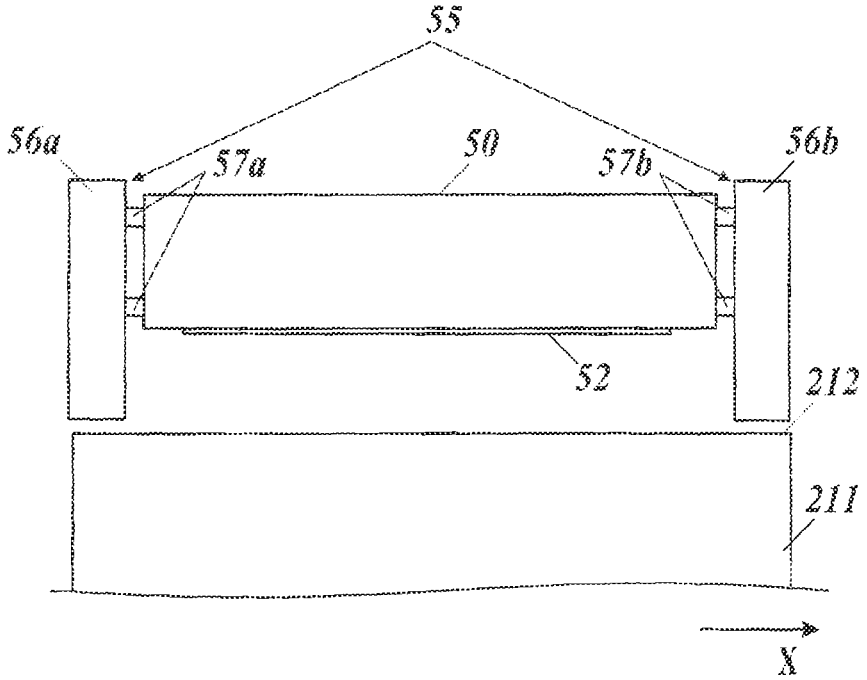
FIG. 3B is a view showing that the head unit is moved by the head unit moving mechanism and the recording head is at a retracted position.

FIGS. 3A and 3B are views for explaining about a head unit moving mechanism (heat source moving unit) 55 which moves the head unit 50. A case is shown where the head unit 50, the head unit moving mechanism. 55 and the conveying drum 211 of the conveying unit 21 are seen from a side direction in a manner similar to FIG. 2A.

The head unit moving mechanism 55 includes a pair of supports 56*a*, 56*b* which are respectively arranged on −X direction side and +X direction side of the head unit 50 and attachment members 57*a*, 57*b* which are respectively attached to the supports 56*a*, 56*b*. The attachment members 57*a*, 57*b* are respectively fixed to the ends on −X direction side and +X direction side of the head unit 50. Also, the attachment members 57*a*, 57*b* are configured so as to move along a direction perpendicular to the conveying surface 212 by a power transduction mechanism which transduces the rotation of a stepping motor (not shown) provided inside or outside of the supports 56*a*, 56*b* to the displacement along a direction perpendicular to the conveying surface 212 of the conveying drum 211. The head unit moving mechanism 55 configured in such a way moves the head unit 50 fixed to the attachment members 57*a*, 57*b* and the recording head 52 included in the head unit 50 along the direction perpendicular to the conveying surface 212 by a distance proportional to the rotating amount of the stepping motor, and changes the distance between the ink ejecting surface of the recording head 52 and the conveying surface 212 of the conveying drum 211. Also, the head unit moving mechanism 55 can switch the moving direction of the head unit 50 in response to the rotating direction of the stepping motor.

In the head unit moving mechanism 55, another motor such as a servomotor may be used in place of the stepping motor described above. The head unit moving mechanism 55 only needs to be configured so as to move the head unit 50 such that the distance between the recording head 52 and the conveying surface 212 is changed. The moving direction of the head unit 50 may not be the direction perpendicular to the conveying direction 212.

By such configuration, the head unit moving mechanism 55 moves the recording head 52 included in the head unit 50 between the operation position (high temperature position) shown in FIG. 3A and the retracted position shown in FIG. 3B.

The operation position is a position of the recording head 52 where a relative relationship with the base 213 of the conveying unit 21 is fixed and is also a position of the recording head 52 when an image is recorded onto the recording medium P by ejecting ink from the recording head 52. When the recording head 52 is at the operation position, the distance between the recording head 52 and the conveying surface 212 of the conveying unit 21 is, for example, 1 mm. The recording head 52 which is positioned at the operation position and is heated by the ink heating unit 54 increases the temperature of the conveying drum 211 by transferring heat to the conveying drum 211 of the conveying unit 21. Hereinafter, the positional range of the heat source where the temperature of the conveying surface 212 of the conveying drum 211 is increased by transferring heat from the heat source is also referred to as proximity of the conveying surface 212.

The retracted position is a position where the recording head 52 is retracted to prevent the temperature of the conveying unit 21 from locally increasing by transferring heat form the recording head 52 when an image is not recorded by the recording head 52. When the recording head 52 is at the retracted position, the distance between the recording head 52 and the conveying surface of the conveying unit 21 is, for example, 10 cm. The retraction of the recording head 52 will be described in detail below.

When the recording head is at the retracted position shown in FIG. 3B, the fixed relative position of the supports 56*a*, 56*b* with respect to the conveying unit 21 is released and a carriage (not shown) to which the both the head unit moving mechanism 55 and the supports 56*a*, 56*b* can be moved to +X direction along a guide rail (not shown) extending along X direction. By this configuration, the head unit 50 can be moved to a position where the recording head 52 included in the head unit 50 is opposed to a cleaning unit (not shown). When the recording head 52 is opposed to the cleaning unit, the ink ejecting surface of the recording head 52 is wiped by a wiping cloth which is provided at the cleaning unit and which is impregnated with a predetermined chemical solution, and ink or other foreign objects attached to the ink ejecting surface are removed.

The fixing unit 24 includes a light emitting unit arranged over the width along X direction of the conveying unit 21 in X direction, and irradiates energy ray such as ultraviolet ray from the light emitting unit to the recording medium P held on the conveying surface 212 of the conveying unit 21 to solidify and fix the ink ejected onto the recording medium P. The fixing unit 24 is arranged so as to be opposed to the conveying surface 212 on the downstream side of the head unit 50 along the conveying direction.

When ultraviolet ray is irradiated as energy ray, as the light emitting unit of the fixing unit 24, a fluorescent tube (low pressure mercury lamp, germicidal lamp), a cold-cathode tube, ultraviolet laser, a low pressure, middle pressure and high pressure mercury lamp which has an operation pressure of a few hundred Pa to 1 MPa, a metal halide lamp, LED (Light Emitting Diode) or the like.

The delivery unit 25 includes an endless belt which is supported by two rollers 251, 252 from inside, and a cylindrical passing drum 254 which passes the recording medium P from the conveying unit 21 to the belt 253. The delivery unit 25 conveys by the belt 253 the recording medium P which is passed from the conveying unit 21 to the belt 253 to send to the sheet ejecting unit 30.

The sheet ejecting unit 30 includes a plate-like ejected sheet tray 31 on which the recording medium P is placed, the recording medium P being sent from the image recording unit 20 by the delivery unit 25.

FIG. 4 is a block diagram showing a main functional configuration of the inkjet recording apparatus 1.

The inkjet recording apparatus 1 includes a control unit 40 including a CPU (Central Processing Unit) (heat source moving control unit, heating control unit, conveying control unit), a RAM (Random Access Memory) 42, a ROM (Read Only Memory) 43 and a storage 44, a conveying drum motor controller circuit 61 which is connected to the conveying drum motor 214, a head unit moving mechanism controller circuit 62 which is connected to the head unit moving mechanism 55, a recording head controller circuit 63 which is connected to the recording head 52, an interface 64 which is connected to an external apparatus 2, an operation display unit 65 which is connected to the interface 64 and the like. The CPU 41 is connected with the RAM 42, the ROM 43, the conveying drum motor controller circuit 61, the head unit moving mechanism controller circuit 62, the recording head controller circuit 63 and the interface 64 via a bus 66.

The CPU 41 performs a variety of arithmetic processing and integrally controls the overall operation of the inkjet recording apparatus 1. For example, the CPU 41 makes the conveying drum motor controller circuit 61 output a control signal to a driving circuit of the conveying drum motor 214 to rotate the conveying drum 211 of the conveying unit 21. Also, the CPU 41 makes the head unit moving mechanism controller circuit 62 output a control signal to a driving circuit of the head unit moving mechanism 55 to operate the head unit moving mechanism. 55 thereby moving the head unit 50. Further, the CPU 41 makes the recording head controller circuit 63 output the image data of an image to be recorded on the recording medium P to the recording head 52 to make the recording head 52 eject ink thereby recording the image on the recording medium. The CPU 41 outputs a control signal to a driving circuit of the ink heating unit 54 to make the ink heating unit 54 heat the ink stored inside the recording head 52.

The RAM 42 provides the CPU 41 with a working memory space to store a temporary data.

The ROM 43 stores a variety of control programs to be executed by the CPU 41, set data or the like. The programs include an image recording program which operates the conveying unit 21, the recording head 52 or the like to record an image on the recording medium P and an emergency stop program which performs an emergency stop of the inkjet recording apparatus 1. In place of the ROM 43, a rewritable nonvolatile memory such as an EEPROM (Electrically Erasable Programmable Read Only Memory) and a flash memory may be used.

The storage 44 is constituted by a DRAM (Dynamic Random Access Memory) or the like. The storage 44 stores the image data of an image which is input from the external apparatus 2 via the interface 64 and which is to be recorded on the recording medium P, and a printing job which includes the type, number or the like of the recording medium P for recording.

The conveying drum motor controller circuit 61 outputs a control signal to operate the conveying drum motor 214 to the conveying drum motor 214 based on the signal input form the CPU 41.

The head unit moving mechanism controller circuit 62 outputs a control signal to operate the head unit moving mechanism 55 to the head unit moving mechanism 55 based on the signal input from the CPU 41.

The recording head controller circuit 63 outputs a control signal (image data) which defines the timing and/or magnitude of the driving voltage to be applied to the piezoelectric element of the recording element from the driving circuit of the recording head 52 based on the signal input from the CPU 41 and the image data stored in the storage 44.

The interface 64 is a unit which performs the transmittance and reception of data between the external apparatus 2 and the operation display unit 65, and is constituted by any one of a variety of serial interfaces and a variety of parallel interfaces and the combination thereof.

The operation display unit 65 includes a display unit such as a liquid crystal display device and an input device such as a light transmissive touch panel attached on the display device. The operation display unit 65 receives a user's input operation and outputs a signal corresponding to the input operation. For example, an input operation concerning an emergency stop by a user is performed on the operation display unit 65. Also, the operation display unit 65 displays an execution result of a program by CPU 41 or the like.

The external apparatus 2 is a personal computer, for example, and transfers image data of an image to be recorded in the inkjet recording apparatus 1 to the control unit 40 via the interface 64.

Next, the operation of the inkjet recording apparatus 1 when the conveying operation of the conveying unit 21 is stopped will be described.

As described above, in the inkjet recording apparatus 1, when an image is recorded, the recording head 52 and the ink stored in the recording head 52 is heated to the range of temperature of 70° C. or more and 90° C. or less, and the conveying drum 211 of the conveying unit 21 is heated to the range of temperature of 40° C. or more and 60° C. or less. Thus, when an image is recorded, the temperature of recording head 52 is higher than the temperature of conveying surface 212 of the conveying drum 211 by equal to or higher than 10° C.

Also, when an image is recorded, the recording head 52 is arranged at an operation position shown in FIG. 3A. At this operation position, although the temperature of the conveying drum 211 increases due to the heat transfer from the recording head 52 to the conveying drum 211, when the conveying unit 21 performs a conveying operation and the conveying drum 211 is rotated, unevenness of temperature on the conveying drum 211 does not occur because the heat from the recording head 52 is transferred to the conveying surface 212 of the conveying drum 211 substantially homogeneously.

However, when the conveying operation of the conveying unit 21 is stopped and the rotation of the conveying drum 211 is stopped, the relative positional relationship between the recording head 52 and the conveying surface 212 of the conveying drum 211 becomes constant, the heat from the recording head 52 is transmitted only to a part of the conveying drum 211, and the temperature of the part of the conveying drum 211 which is opposed to the recording head 52 locally increases resulting in unevenness of temperature.

When the recording medium P is picked up on the conveying drum 211 in a state where unevenness of temperature occurs, or when the recording medium P is held on such a conveying drum 211, unevenness of temperature occurs also on the recording medium P with a distribution reflecting the unevenness of temperature of the conveying drum 211. When an image is recorded by ejecting ink to the recording medium P, the image quality of the recorded image is lowered because the solidification of ink ejected onto the recording medium P is varied due to the unevenness of temperature of the recording medium P, for example.

In the inkjet recording apparatus 1 of the present embodiment, when the conveying operation of the conveying unit 21 is stopped such that the conveying operation can be resumed, the head unit moving mechanism 55 moves the recording head 52 from the operation position to the retracted position. That is, the recording head 52 is moved by the head unit moving mechanism 55 such that the distance between the recording head 52 and the conveying surface 212 is increased. Therefore, it becomes difficult for heat to transfer from the recording head 52 to the conveying drum 211.

The distance between the recording head 52 at the retracted position and the conveying surface 212 is a retracted distance. The distance between the recording head 52 at the operation position and the conveying surface 212 is an operating distance. When the the difference in temperature of the recording head 52 and the conveying drum 211 is larger, a larger difference between the retracted distance and the operation distance may be set. The difference between the retracted distance and the operation distance may be changed based on a planned stopped time of rotation of the conveying unit 21, the amount of heat capacity and heat conductivity of the conveying unit 21, type of ink or the like.

The case where the conveying operation of the conveying unit 21 is stopped in a state where the conveying operation can be resumed includes a case where a normal image recording operation is stopped, a case where a user inputs operation to instruct to stop an image recording operation or to stop conveying operation by the conveying unit 21, and a case where the CPU 41 performs an interrupt processing concerning an emergency stop when a predetermined condition is satisfied and an interlock mechanism operates. The examples of predetermined conditions where the interlock mechanism operates include an occurrence of an operation error in a predetermined component which can cause a problem in recording an image by the inkjet recording apparatus 1, an external input of an instruction of an emergency stop, an occurrence of an earthquake, and an opened door of a storage space when the inkjet recording apparatus 1 is stored in the storage space for ensuring security.

In the following, with respect to the operation in which the conveying operation of the conveying unit 21 is stopped, a normal image recording processing and an emergency stop processing are described as examples.

Figure 5:
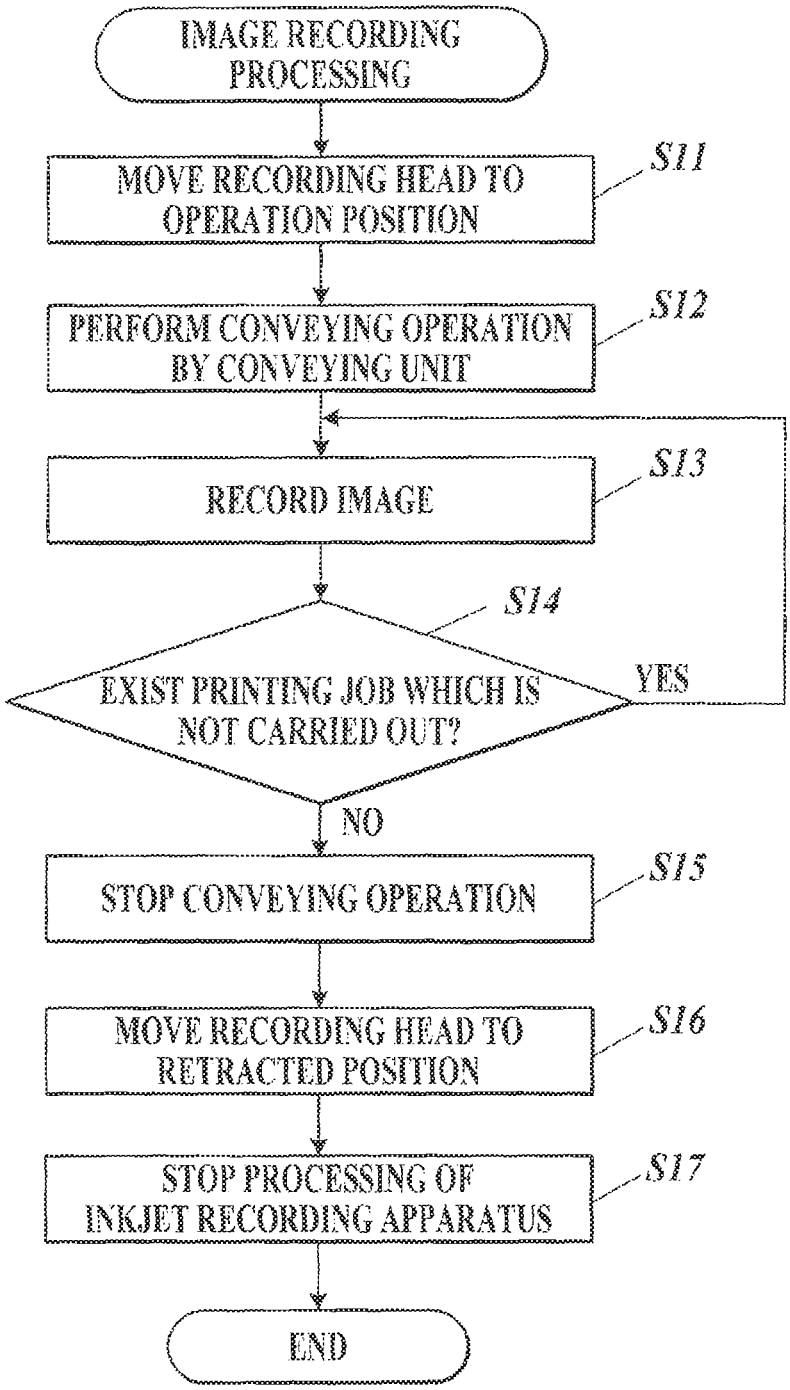
FIG. 5 is a flowchart showing a control procedure of an image recording processing.

FIG. 5 is a flowchart showing a control procedure of an image recording processing.

This image recording processing is carried out, when a printing job including image data is input to the control unit 40 from the external apparatus 2, for example.

Before the start of this image recording processing, the ink in the recording head 52 is heated to a predetermined set temperature by ink heating unit 54 in accordance with the type of the ink. The conveying drum 211 of the conveying unit 21 is heated to a predetermined set temperature by the conveying drum heating unit 23. In the present embodiment, the ink in the recording head 52 is heated to a temperature within a range of 70° C. or more and 90° C. or less and the conveying drum 211 is heated to a temperature within a range of 40° C. or more and 60° C. or less.

The CPU 41 makes the head unit moving mechanism controller circuit 62 output a control signal to the head unit moving mechanism 55 whereby the head unit moving mechanism 55 moves the head unit 50 such that the recording head 52 is arranged at the operation position (Step S11).

The CPU 41 makes the conveying drum motor controller circuit 61 output a control signal to the conveying drum motor 214 to operate the conveying drum motor 214 whereby the conveying drum 211 rotates and the conveying unit 21 performs conveying operation (Step S12).

The CPU 41 makes each of the sheet feeding unit 10 and the image recording unit 20 operate and record an image on the recording medium P which is conveyed by the conveying unit 21 based on a printing job which is stored in the storage 44 (Step S13). Specifically, the CPU 41 outputs a control signal to the conveyer 12 and the passing unit 22 to convey the recording medium P from the sheet feeding unit 10 onto the conveying unit 21 and to make the conveying unit 21 hold and convey the recording medium P. The CPU 41 makes the image data stored in the storage 44 output from the recording head controller circuit 63 to the recording head 52 whereby an image is recorded on the recording medium P by ejecting ink from the recording head 52 onto the recording medium P conveyed by the conveying unit 21. The CPU makes the recording medium P on which an image is recorded be conveyed to the position of the fixing unit 24 to fix the ink on the recording medium P by the fixing unit 24. The CPU 41 makes the delivery unit 25 convey the recording medium P on which ink is fixed to the sheet ejecting unit 30.

The CPU 41 determines whether a printing job which is not carried out is stored in the storage 44 (Step S14). If the CPU 41 determines that a printing job which is not carried out is stored in the storage 44 ("YES" in Step S14), the CPU 41 shifts the processing to Step S13 to carry out the image recording in accordance with the printing job which is not carried out.

If the CPU 41 determines that a printing job which is not carried out is not stored in the storage 44 ("NO" in Step S14), the CPU 41 makes the conveying drum motor controller circuit 61 output a control signal to the conveying drum motor 214 to stop the operation of the conveying drum motor 214 whereby the rotation of the conveying drum 211 is stopped to stop the conveying operation of the conveying unit 21 (Step S15).

The CPU 41 makes the head unit moving mechanism controller circuit 62 output a control signal to the head unit moving mechanism 55 to move the head unit 50 by the head unit moving mechanism 55 such that the recording head 52 is moved from the operation position to the retracted position (Step S16; heat source moving step).

The CPU 41 carries out a stop processing of the inkjet recording apparatus 1 (Step S17). The CPU 41 makes each component of the inkjet recording apparatus 1 transfer to a predetermined state set as a starting state of the image recording processing.

When the processing of Step S17 is finished, the CPU 41 finishes the image recording processing.

Next, the emergency stop processing which is carried out in the inkjet recording apparatus 1 will be explained.

Figure 6:
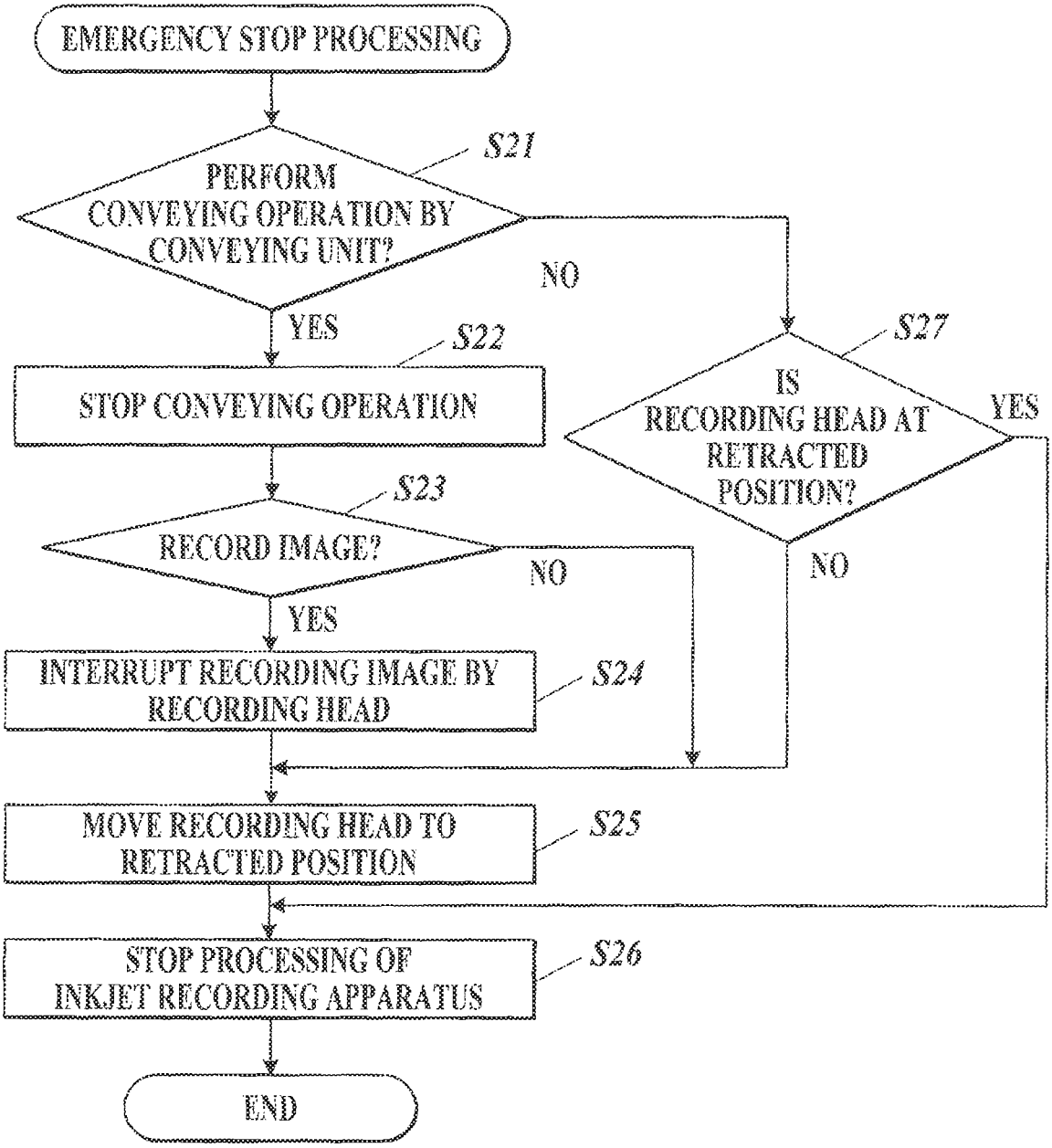
FIG. 6 is a flowchart showing a control procedure of an emergency stop processing.

FIG. 6 is a flowchart showing a control procedure of an emergency stop processing.

This emergency stop processing is carried out by the inkjet recording apparatus 1 which performs image recording processing when a predetermined abnormal condition occurs. Specifically, this emergency stop processing is an interrupt processing carried out when an interrupt request signal concerning an emergency stop interaction is sent to the CPU 41 via the interface 64 in case where a user performs an input operation in the external apparatus 2 or the operation display unit 65 to instruct the stop of the image recording operation or the stop of the conveying operation of the conveying unit 21, or when the interrupt request signal is sent to the CPU 41 in case where the interlock mechanism described above operates.

When the interrupt request signal described above is input, the CPU 41 determines whether the conveying drum 211 rotates, that is whether the conveying unit 21 performs conveying operation (Step S21).

When the CPU 41 determines that the conveying unit 21 performs the conveying operation ("YES" in Step S21), the CPU 41 makes the conveying drum motor controller circuit 61 output a control signal to the conveying drum motor 214 to stop the operation of the conveying drum motor 214 whereby the rotation of the conveying drum 211 is stopped and the conveying operation of the conveying unit 21 is stopped (Step S22).

The CPU 41 determines whether the recording head 52 performs the recording of an image (Step S23).

When the CPU 41 determines that the recording head 52 performs the recording of an image ("YES" in Step S23), the CPU 41 makes the recording head controller circuit 63 output a control signal to the recording head 52 to make the recording head controller circuit 63 stop the ejection of ink by the recording head 52 whereby the recording of an image by the recording head 52 is interrupted (Step S24).

Step S23 and Step S24 may be performed at the same time as Step S22 after the processing of the CPU 41 for stopping the conveying operation of the conveying unit 21 and before the rotation of the conveying drum 211 is stopped completely.

When the processing of Step S24 is finished, the CPU 41 makes the head unit moving mechanism controller circuit 62 output a control signal to the head unit moving mechanism 55 to move the head unit 50 by the head unit moving mechanism 55 such that the recording head 52 is moved from the operation position to the retracted position (Step S25; heat source moving step).

When the CPU 41 determines that the recording head 52 does not perform the recording of an image in Step S23 ("NO" in Step S23), the CPU 41 shifts the processing to Step S25.

When the processing of Step S25 is finished, the CPU 41 performs the stop processing of the inkjet recording apparatus 1 (Step S26). The CPU 41 makes each component of the inkjet recording apparatus 1 transfer to a predetermined state set as a starting state of the image recording processing.

When the CPU 41 determines that the conveying unit 21 does not perform the conveying operation ("NO" in Step S21), the CPU 41 determines whether the recording head 52 is at the retracted position (Step S27).

When the CPU 41 determines that the recording head 52 is not at the retracted position ("NO" in Step S27), the CPU 41 shifts the processing to Step S25. When the CPU 41 determines that the recording head 52 is at the retracted position ("YES" in Step S27), the CPU 41 shifts the processing to Step S26.

When the processing of Step S26 is finished, the CPU 41 ends the emergency stop processing.

As described above, the inkjet recording apparatus 1 according to the present embodiment includes the conveying unit 21 which performs a conveying operation to rotate the conveying drum 211 thereby conveying the recording medium P placed on the conveying surface 212 of the conveying drum 211; the recording head 52 which records an image by ejecting ink to the recording medium P conveyed by the conveying unit 21; the recording head 52 as a heat source; the head unit moving unit 55 which moves the recording head 52; and the CPU 41 as a heat source moving control unit which moves the recording head 52 by the recording head moving unit 55 such that a distance between the recording head 52 and the conveying surface 212 increases when the conveying operation which is performed by the conveying unit 21 stops in a manner in which the conveying operation can be resumed in a state where the recording head 52 is positioned in proximity of the conveying surface 212. In such a way, the increase of temperature of the conveying surface 212 of the conveying drum 211 is suppressed when the conveying operation of the conveying unit 21 is stopped. Thus, the occurrence of unevenness of the temperature of the conveying surface 212 of the conveying drum 211 can be suppressed. As a result, since the unevenness of temperature of the recording medium P held on the conveying drum 211 can be suppressed when the conveying operation is performed and recording an image is resumed, the decrease of the image quality of the recorded image resulting from the unevenness of the temperature of the recording medium P can be suppressed.

The recording head 52 includes a configuration which serves as the heat source, and the head unit moving unit 55 moves the heat source by moving the recording head 52. In such a way, in the inkjet recording apparatus 1 in which the recording head 52 has higher temperature than that of the conveying drum 211, the occurrence of unevenness of temperature of the conveying surface 212 of the conveying drum 211 when the conveying operation of the conveying operation 21 is stopped.

The inkjet recording apparatus 1 includes an ink heating unit 54 which heats ink which is stored in the recording head 52 and which is to be ejected, wherein the CPU 41 as a heating control unit heats the ink by the ink heating unit 54 to a temperature higher than a temperature of the conveying surface 212 of the conveying drum 211, and the recording head 52 is configured to transmit heat of the ink heating unit 54 to the configuration which serves as the heat source. In such a way, in an aspect in which ink stored in the recording head 52 is heated and the heated ink is ejected from the recording head 52, the unevenness of temperature of the conveying surface 212 of the conveying drum 211 resulting from the heated recording head 52 can be suppressed when the conveying operation of the conveying unit 21 is stopped.

The CPU 41 as the heating control unit heats the ink by the ink heating unit 54 to a temperature higher than a temperature of the conveying surface 212 of the conveying drum 211 by 10° C. or more. As a result, the increase of temperature of the conveying drum 211 becomes eminent due to the heat transmission from the recording head 52 arranged at the operation position to the conveying drum 211. However, the occurrence of unevenness of temperature of the conveying surface 212 of the conveying drum 211 can be suppressed by moving the recording head 52 such that the distance between the recording head 52 and the conveying surface 212 increases when the conveying operation of the conveying unit 21 is stopped.

The ink which is stored in the recording head 52 has a characteristic that the ink is gel-like at normal temperature and becomes sol-like when the ink is heated, the CPU 41 as the heating control unit heats the ink by the ink heating unit 54 to a temperature at which the ink becomes sol-like, and the recording head 52 ejects the sol-like ink which is heated by the ink heating unit 54 to the recording medium P. In such a way, the sol-like ink ejected onto the recording medium P is cooled and becomes gel-like thereby an image is recorded on the recording medium P in a manner in which the ink is shortly solidified.

The recording head 52 included in the head unit 50 ejects ink from a plurality of recording elements 53 arranged along a widthwise direction perpendicular to a conveying direction of the recording medium P by the conveying unit 21 over a recording width of the recording medium P in the widthwise direction in a direction intersecting with the conveying direction. In such a way, in an inkjet recording apparatus 1 of a single path system in which an image is recorded in a state where the position of the recording head 52 relative to the conveying unit 21 is fixed, the occurrence of unevenness of temperature on the conveying surface 212 of the conveying drum 211 can be suppressed when the conveying operation of the conveying drum 211 of the conveying unit 21 is stopped.

The conveying drum 211 includes the conveying surface 212 having a cylindrical surface shape, and the conveying unit 21 performs the conveying operation by rotating the conveying surface 212. In such a way, when the conveying operation of the conveying unit 21 is performed, the increase of temperature at each part of the conveying drum 211 due to heat from the recording head 52 at the operation position can be made uniform.

The inkjet recording apparatus 1 includes a conveying drum heating unit 23 which heats the conveying surface 212 of the conveying drum 211. In such a way, even when the recording head 52 is heated to a high temperature, the difference in temperature between the recording head 52 and the conveying drum 211 can be made within a predetermined range.

The CPU 41 as a conveying control unit stops the conveying operation of the conveying unit 21 when a predetermined abnormal condition occurs. In such a way, when an abnormal condition occurs in the inkjet recording apparatus 1, the conveying operation of the conveying unit 21 is stopped to ensure security. Also, the occurrence of unevenness in temperature on the conveying surface 212 of the conveying drum 211 can be suppressed when the conveying operation of the conveying unit 21 is stopped.

The present invention is not limited to the embodiment and variation described above, but a variety of modification is possible.

For example, in the embodiment described above, an example in which the entire recording head 52 heated by the ink heating unit 54 correspond to a heat source. However, this is not limitative. The heat from the ink heating unit 54 may be configured to be transmitted to a part of the structure of the recording head 52, and an aspect in which the part of the structure may correspond to the heat source is possible.

Also, in the embodiment described above, an example in which the recording head 52 corresponds to a heat source. However, this is not limitative. Any component which is positioned in the proximity of the conveying surface 212 of the conveying drum 211 and which has a temperature different from that of the conveying surface 212 of the conveying drum 211 may correspond to a heat source, such any component including the conveying drum heating unit 23 and the fixing unit 24 whose temperature increases by generating heat when irradiating an energy ray. Thus, when the conveying operation of the conveying unit 21 is stopped, the heat source may be moved such that the distance between the heat source and the conveying surface 212 increases.

In the embodiment described above, as an example of the conveying unit, the conveying unit 21 which rotates the conveying drum 211 around the base 213 is explained. However, this is not limitative. Any conveying unit which holds a recording medium on the conveying surface of the conveying member and which conveys the recording medium P by the conveying member moving relative to a base may be used. For example, a conveying unit may be used which includes a belt as a conveying member which is supported by two rollers as a base thereby rotating around the two rollers in response to the rotation of the rollers and which holds a recording medium P on a conveying surface of the belt.

In the embodiment described above, the inkjet recording apparatus 1 which heats ink which is gel-like at normal temperature and becomes sol-like by being heated to an extent that the ink becomes sol-like and ejects the ink is explained as an example. However, this is not limitative. A variety of known ink including sol-like or liquid ink at normal temperature may be used. For example, ink which is sol-like at normal temperature may be used and such ink may be ejected after viscosity is reduced by heating the ink.

In the embodiment described above, an example in which the head unit 50 is provided with eight recording head modules 51 and the recording heads 52 as recording units and each recording head 52 is provided with two rows of recording elements 53. However, this is not limitative. For example, the number of rows of recording elements 53 included in each recording head 52 may be one row or three rows or more. Also, the number of the recording heads 52 included in each recording head module 51 may be one or three or more. Further, the head unit 50 may be constituted by a single recording head module 51 or recording head 52. In any case, by arranging a recording element(s) of one or more recording heads 52 included in the head unit 50 over the recording width in X direction of the recording medium P, the inkjet recording apparatus 1 of single path system can be formed. In this case, one or more recording heads 52 included in the head unit 50 correspond to the recording unit.

Although an example of the inkjet recording apparatus 1 of a single path system is explained in the embodiment described above, the present invention may be applied to an inkjet recording apparatus which records an image while a recording head is being scanned in the main scanning direction (the direction perpendicular to the conveying direction of a recording medium P).

Although some embodiments of the present invention are explained, the scope of the present invention is not limited to the embodiment described above, but includes the scope of the invention described in the claims and equivalents thereof.

INDUSTRIAL APPLICABILITY

The present invention can be used for an inkjet recording apparatus and a method of controlling an inkjet recording apparatus.

REFERENCE SIGNS LIST 1 inkjet recording apparatus
2 external apparatus
10 sheet feeding unit
11 sheet tray

12 conveyer
20 image recording unit
21 conveying unit
211 conveying drum
212 conveying surface
213 base
214 conveying drum motor
22 passing unit
23 conveying drum heating unit
24 fixing unit
25 delivery unit
30 sheet ejecting unit
31 ejected sheet tray
40 control unit
41 CPU
42 RAM
43 ROM
44 storage
50, 50Y, 50M, 50C, 50K head unit
51 recording head module
52 recording head
53 recording element
54 ink heating unit
55 head unit moving mechanism
56*a*, 56*b* support
57*a*, 57*b* attachment member
61 conveying drum motor controller circuit
62 head unit moving mechanism controller circuit
63 recording head controller circuit
64 interface
65 operation display unit
66 bus
P recording medium

The invention claimed is:

1. An inkjet recording apparatus comprising:

a conveying unit which performs a conveying operation to move a conveying member thereby conveying a recording medium placed on a conveying surface of the conveying member;

a recording unit which records an image by ejecting ink to the recording medium conveyed by the conveying unit;

a heat source;

a heat source moving unit which moves the heat source;

a heat source moving control unit executing a program to perform a function of moving the heat source by the heat source moving unit such that a distance between the heat source and the conveying surface increases when the conveying operation which is performed by the conveying unit stops in a manner in which the conveying operation can be resumed in a state where the heat source is positioned in proximity of the conveying surface, wherein the recording medium is a cut sheet, the recording unit includes a configuration which serves as a heat source, the heat source moving unit moves the heat source by moving the recording unit, an ink heating unit which heats ink which is stored in the recording unit and which is to be ejected, a heating control unit which executes a program to perform a function of heating the ink by the ink heating unit, the recording unit transmits heat of the ink heating unit to the configuration which serves as the heat source, the ink heating unit is in proximity to and directly opposite the conveying surface, and the heat source moving control unit executes the program such that the distance between the heat source and the conveying surface increases in proportion to a difference between a temperature of the heat source and a temperature of the conveying surface.

2. The inkjet recording apparatus according to claim 1, wherein:

the ink heated by the ink heating unit is heated to a temperature higher than a temperature of the conveying surface of the conveying member.

3. The inkjet recording apparatus according to claim 1, wherein the heating control unit executes a program to perform a function of heating the ink by the ink heating unit to a temperature higher than a temperature of the conveying surface of the conveying member by 10° C. or more.

4. The inkjet recording apparatus according to claim 1, wherein ink which is stored in the recording unit has a characteristic that the ink is gel-like at normal temperature and becomes sol-like when the ink is heated, the heating control unit executes a program to perform a function to heat the ink by the ink heating unit to a temperature at which the ink becomes sol-like, and the recording unit ejects the sol-like ink which is heated by the ink heating unit to the recording medium.

5. The inkjet recording apparatus according to claim 1, wherein the recording unit ejects ink from a plurality of recording elements arranged along a widthwise direction perpendicular to a conveying direction of the recording medium by the conveying unit over a recording width of the recording medium in the widthwise direction in a direction intersecting with the conveying direction.

6. The inkjet recording apparatus according to claim 1, wherein the conveying member includes the conveying surface having a cylindrical surface shape, and the conveying unit performs the conveying operation by rotating the conveying surface.

7. The inkjet recording apparatus according to claim 1, further comprising a conveying member heating unit which heats the conveying surface of the conveying member.

8. The inkjet recording apparatus according to claim 1, further comprising a conveying control unit which stops the conveying operation of the conveying unit when a predetermined abnormal condition occurs.

9. A method of control an inkjet recording apparatus comprising: a conveying unit which performs a conveying operation to move a conveying member thereby conveying a recording medium placed on a conveying surface of the conveying member; a recording unit which records an image by ejecting ink to the recording medium conveyed by the conveying unit; a heat source; and a heat source moving unit which moves the heat source, the method comprising:

a step of moving a heat source which moves the heat source by the heat source moving unit such that a distance between the heat source and the conveying surface increases when the conveying operation which is performed by the conveying unit stops in a manner in which the conveying operation can be resumed in a state where the heat source is positioned in proximity of the conveying surface, wherein the recording medium is a cut sheet, the recording unit includes a configuration which serves as the heat source, the heat source moving unit moves the heat source by moving the recording unit, an ink heating unit which heats the ink which is stored in the recording unit and which is to be ejected, a heating control unit which executes a program to perform a function of heating the ink by the ink heating unit, the recording unit transmits heat of the ink heating unit to the configuration which serves as the heat source, the ink heating unit is in proximity to and directly opposing the conveying surface, and the heat source moving control unit executes the program such that the distance between the heat source and the conveying surface increases in proportion to a difference between a temperature of the heat source and a temperature of the conveying surface.

* * * * *